US005341945A

United States Patent [19]

Gibson

[11] Patent Number: 5,341,945

[45] Date of Patent: Aug. 30, 1994

[54] SHELF DIVIDER SYSTEM

[75] Inventor: Scott S. Gibson, Mercer Island, Wash.

[73] Assignee: Burke Gibson, Inc., Auburn, Wash.

[21] Appl. No.: 114,508

[22] Filed: Aug. 31, 1993

[51] Int. Cl.[5] ..... A47F 5/00

[52] U.S. Cl. ..... 211/184; 108/60

[58] Field of Search ..... 211/184; 108/60, 61

[56] References Cited

U.S. PATENT DOCUMENTS

| | | | |
|---|---|---|---|
| 2,884,139 | 4/1959 | Dunham | 211/184 |
| 2,982,423 | 5/1961 | Handler et al. | 211/136 |
| 3,139,186 | 6/1964 | George | 211/55 |
| 3,698,568 | 10/1972 | Armstrong | 211/184 |
| 3,830,169 | 8/1974 | Madey | 108/61 |
| 3,868,021 | 2/1975 | Heinrich | 211/184 |
| 3,893,739 | 7/1975 | Bernard | 211/184 X |
| 4,488,653 | 12/1984 | Belokin | 211/184 |
| 4,615,276 | 10/1986 | Garabedian | 108/61 |
| 4,712,694 | 12/1987 | Breslow | 211/184 |
| 4,735,324 | 4/1988 | Wilcek | 211/184 |
| 4,775,058 | 10/1988 | Yatsko | 211/184 |
| 4,830,201 | 5/1989 | Breslow | 211/184 |
| 4,896,779 | 1/1990 | Jureckson | 211/184 |
| 5,082,125 | 1/1992 | Ninni | 108/61 X |
| 5,161,704 | 11/1992 | Valiulis | 211/184 |

*Primary Examiner*—Alvin C. Chin-Shue
*Assistant Examiner*—Sarah A. Lechok
*Attorney, Agent, or Firm*—Delbert J. Barnard; Teresa J. Wiant

[57] ABSTRACT

The present invention provides a shelf divider system (10) for organizing merchandise on a shelf (16). The system (10) comprises a shelf divider (12) and an edge member (14). In use, the shelf divider (12) may be snap-fit to the edge member (14) by connecting a hook (84) on the shelf divider to a bead (20) on the edge member.

8 Claims, 4 Drawing Sheets

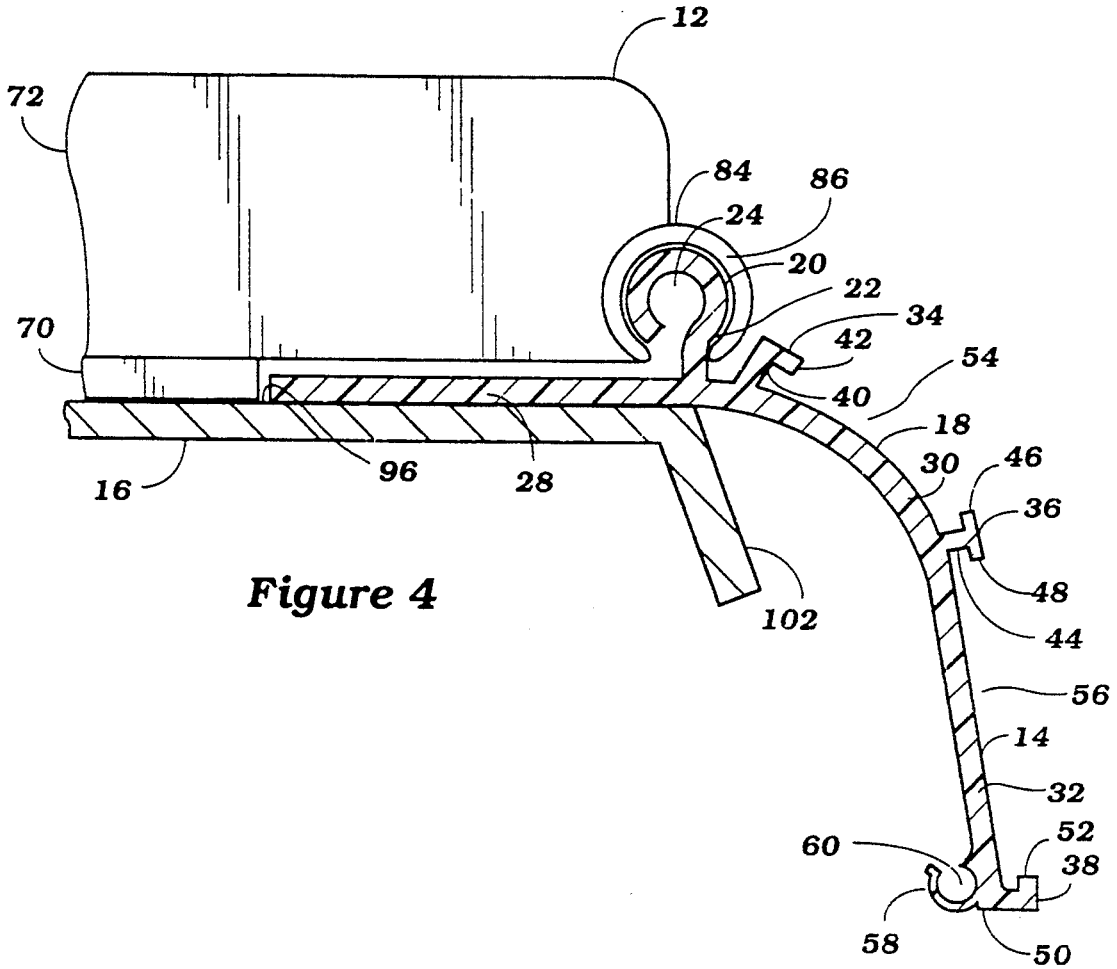
Figure 4
Figure 5
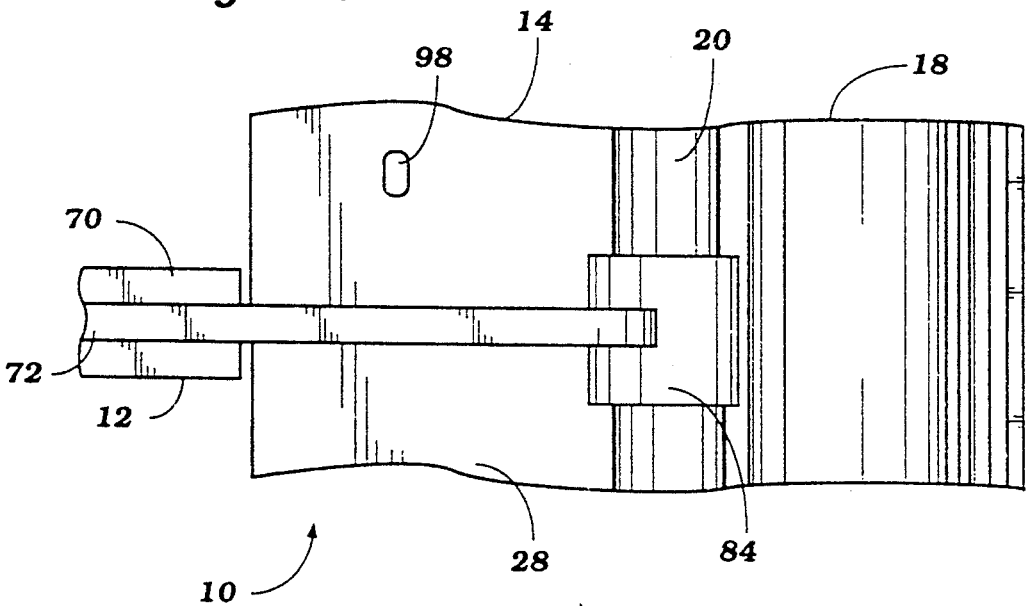

SHELF DIVIDER SYSTEM

TECHNICAL FIELD

This invention relates to a shelf divider system for separating and organizing merchandise on a shelf. More particularly, this invention relates to a shelf divider system which includes shelf dividers which are snap-fitted onto a bead on a front of a shelf.

BACKGROUND OF THE INVENTION

It is often necessary to display more than one type of merchandise on a shelf. For this reason, it is desirable to separate different types of merchandise from each other on the shelf to facilitate inspection and selection by customers. Shelf dividers may be installed on a shelf to separate such merchandise. It is desirable for such shelf dividers to be easily installable and removable such that the merchandise on the shelf may be rearranged. Prior art shelf divider systems which exist in the patent literature are disclosed by the following U.S. Pat. Nos. 2,884,139, granted Apr. 28, 1959 to Thomas M. Dunham; No. 2,982,423, granted May 2, 1961, to Milton E. Handler and Ralph J. Bellon; No. 3,139,186, granted Jun. 30, 1964 to Van George; No. 3,698,568, granted Oct. 17, 1972 to Blair D. Armstrong; No. 3,830,169, granted Aug. 20, 1974, to Marion J. Madey; No. 3,868,021, granted Feb. 25, 1975, to Wilhelm Heinrich; No. 4,488,653, granted Dec. 18, 1984, to Paul Belokin; No. 4,615,276, granted Oct. 7, 1986, to Aram G. Garabedian; No. 4,712,694, granted Dec. 15, 1987, to David Breslow; No. 4,735,324, granted Apr. 5, 1988 to Joe E. Wilcek; No. 4,775,058, granted Oct. 4, 1988, to John P. Yatsko; No. 4,830,210, granted May 16, 1989 to David S. Breslow; and No. 4,896,779, granted Jan. 30, 1990, to Mitchell Jureckson. These patents should be carefully considered for the purpose of putting the present invention into proper perspective relative to the prior art.

DISCLOSURE OF THE INVENTION

The present invention provides an elongated shelf divider for use with a shelf having an upstanding bead extending along a front edge of the shelf. The shelf divider comprises an arm and a front end. The arm has a lower base edge that is settable on a shelf. The front end comprises a hook having a tubular body. The tubular body defines an inner space and a downwardly directed hook throat is defined between the jaws. The inner space has a substantially circular cross-sectional shape close in diameter to the diameter of the bead. The hook throat has a width less than the diameter of the bead. The shelf divider can be moved into a position above a shelf with a bead. Then, the shelf divider can be moved downwardly to place the jaws on the bead. Then, the shelf divider can be moved further downwardly with the bead being received in the hook throat and then in the inner space to snap-fit the hook onto the bead. When the hook is connected to the bead, the shelf divider extends generally perpendicular to the bead. The tubular body has sufficient length such that the connection between the hook and the bead substantially prevents sideways pivotal movement of the hook relative to the bead.

According to another aspect of the invention, a shelf divider system is provided for use with a shelf on which merchandise is displayed. The shelf divider system comprises an elongated edge member and an elongated shelf divider. The edge member includes a base and an elongated bead upstanding from the base. The bead has a substantially cylindrical shape. A stem connects the bead to the base. In use, the edge member is located at a front edge of a shelf. The shelf divider has an arm and a front end. The arm has a lower base edge that is settable on a shelf. The front end comprises a hook having a tubular body. The tubular body defines an inner space. The tubular body has jaws and a downwardly-directed hook throat is defined between the jaws. The inner space has a substantially circular cross-sectional shape close in diameter to the diameter of the bead. The hook throat has a width less than the diameter of the bead. The shelf divider can be moved into a position above a shelf to which the edge member is secured. Then, the shelf divider is moved downwardly to place the jaws on the bead. Then, the shelf divider can be moved further downwardly with the bead being received in the hook throat and then in the inner space to snap-fit the hook onto the bead. When the hook is connected to the bead, the shelf divider extends generally perpendicular to the bead. The tubular body has sufficient length such that the connection between the hook and the bead substantially prevents sideways pivotal movement of the hook relative to the bead.

In a preferred form of the invention, the arm of the shelf divider includes an elongated foundation member and a divider wall. The foundation member provides the lower base edge. The divider wall extends from the foundation member. The divider wall has a width less than the width of the foundation member such that the divider wall and the foundation member form a member having a T-shaped cross-sectional area. When the hook is connected to the bead, the width of the foundation member substantially prevents sideways rotational movement of the divider wall relative to the bead.

In another preferred form of the invention, the jaws of the tubular body include a cam surface for camming the bead into and through the hook throat. There may be two cam surfaces provided, one on either jaw of the hook.

These and other advantages and features will become apparent from the detailed description of the best mode for carrying out the invention that follows.

BRIEF DESCRIPTION OF THE DRAWINGS

Like reference numerals are used to denote like parts throughout the several figures of the drawing, and:

FIG. 4 shows the shelf divider and edge member of FIGS. 2 and 3 with the shelf divider installed on the edge member;

FIG. 5 is a fragmentary top view of the shelf divider installed on the edge member;

BEST MODE FOR CARRYING OUT THE INVENTION

Figure 1:
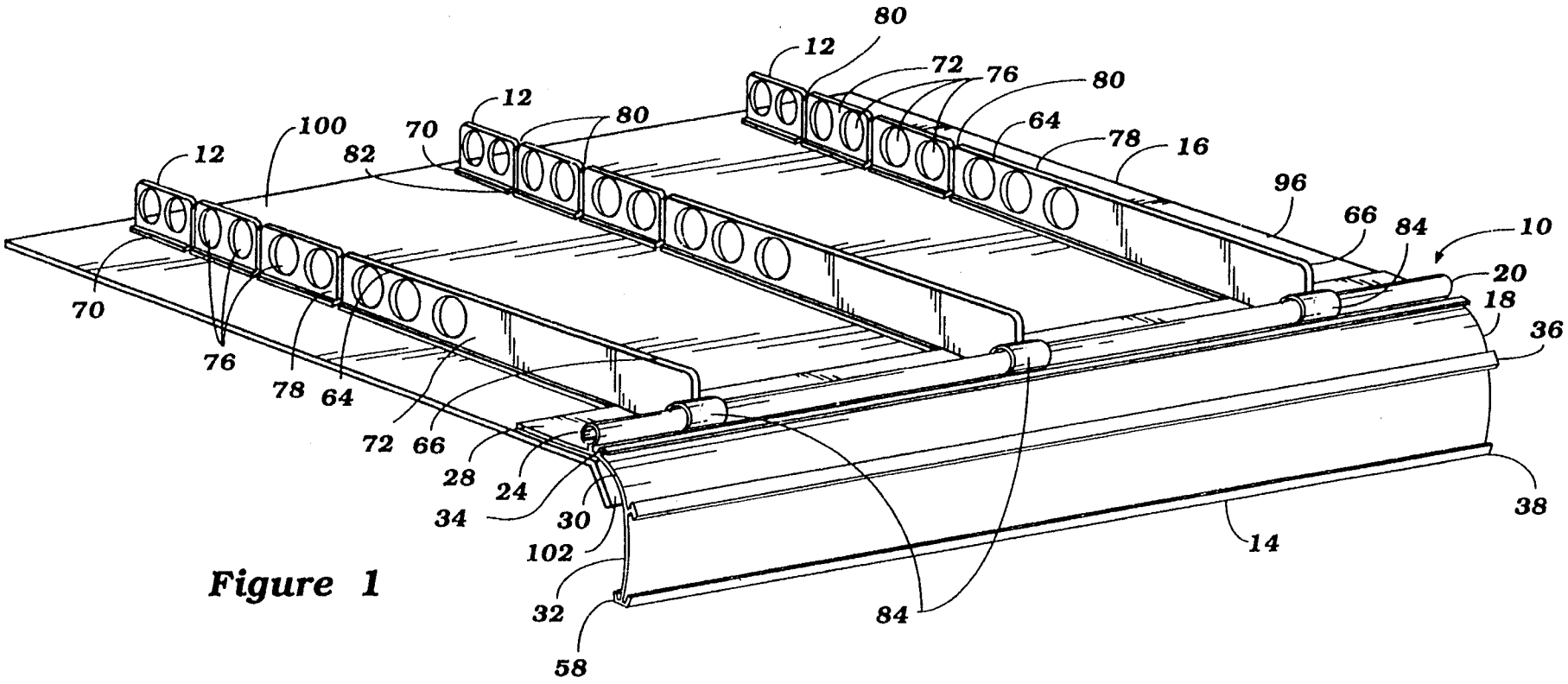
FIG. 1 is a pictorial view of an edge member and shelf divider system of the present invention installed on a shelf.

The present invention provides a shelf divider system 10 which includes shelf dividers 12 and an edge member 14 on a shelf 16, as illustrated in FIG. 1. The shelf divider system 10 is useful for organizing and arranging merchandise on a shelf 16.

Figure 2:
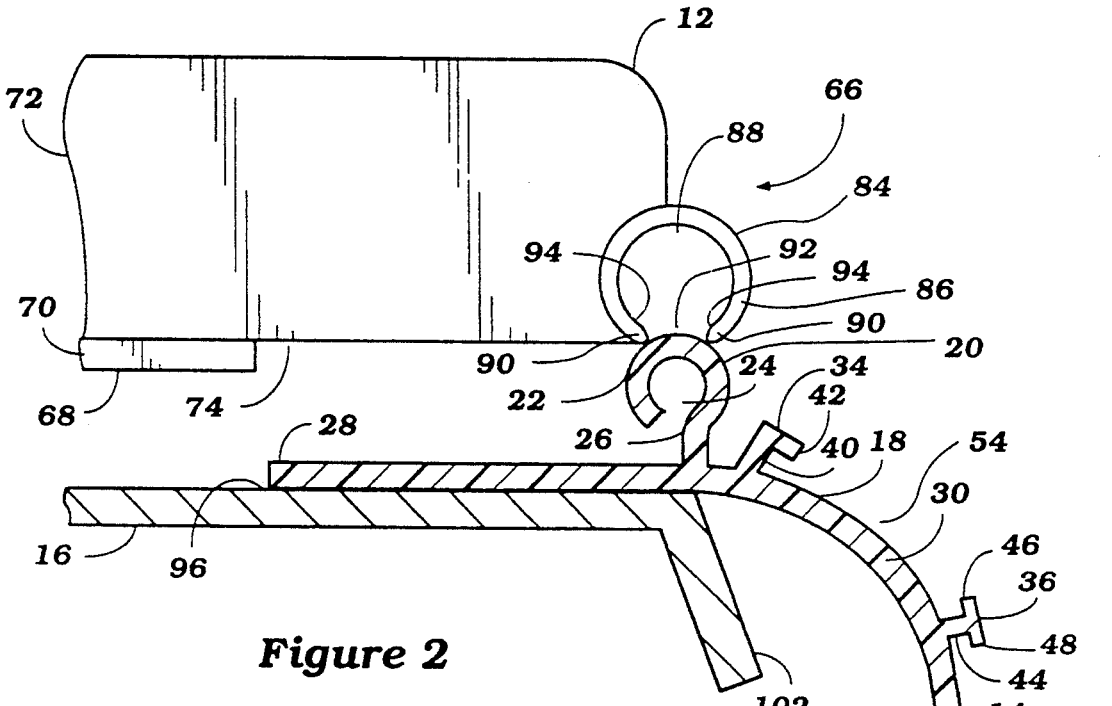
FIG. 2 is a fragmentary side view of a shelf divider positioned to be installed on an edge member, with the edge member and shelf shown in section.
Figure 3:
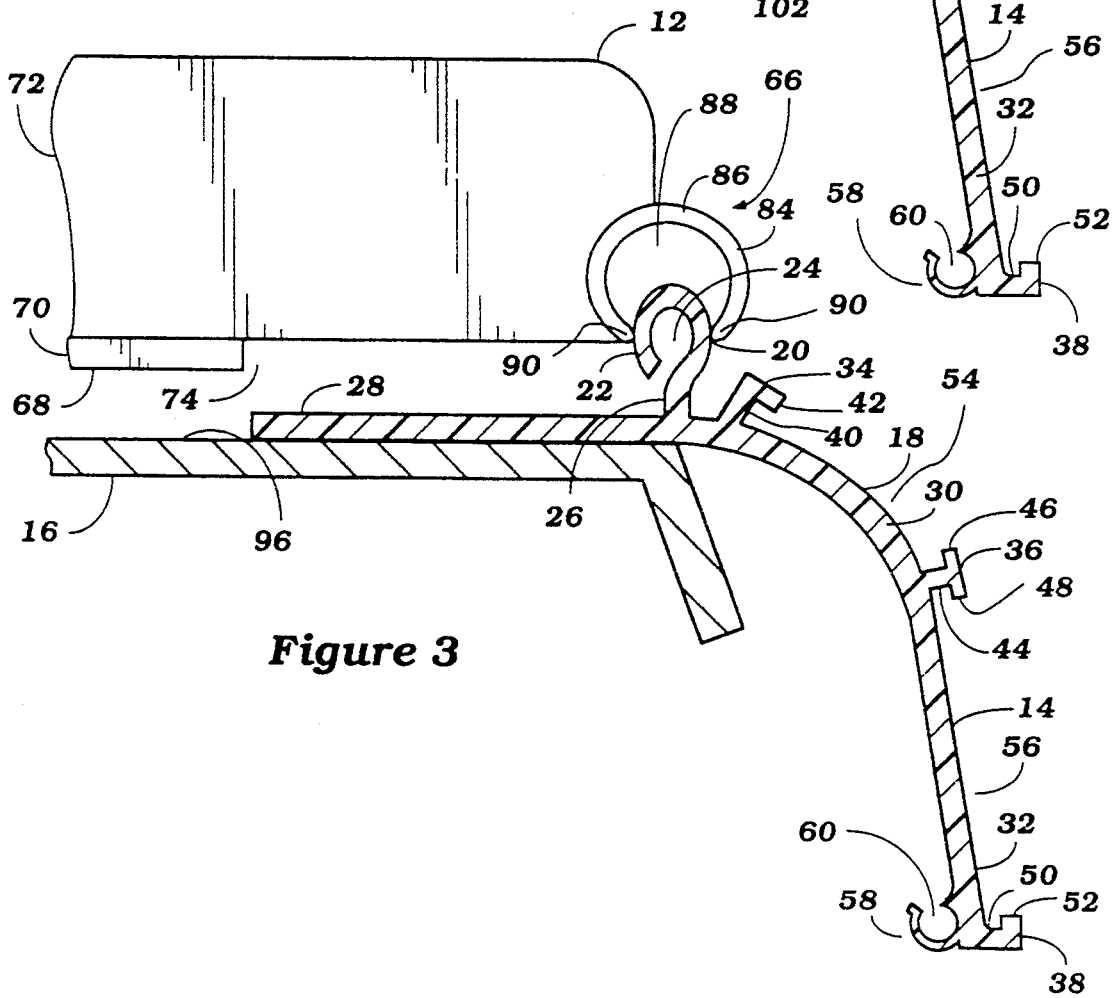
FIG. 3 shows the shelf divider and edge member illustrated in FIG. 2 as the shelf divider is being installed on the edge member.
Figure 6:
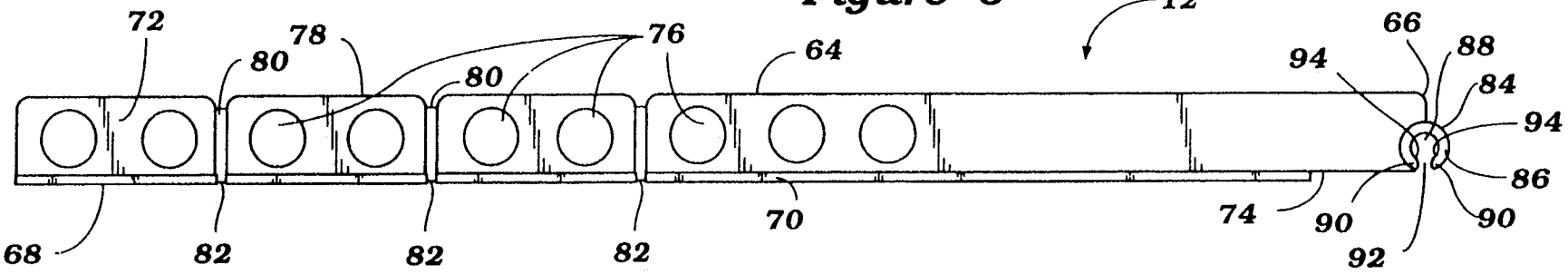
FIG. 6 is a side view of the shelf divider of the present invention.
Figure 7:
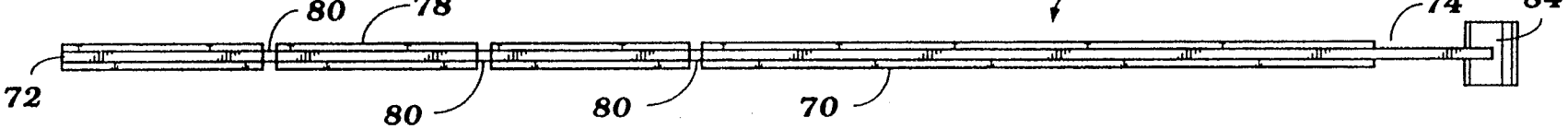
FIG. 7 is a top view of the shelf divider shown in FIG. 6.

The edge member 14 includes an elongated base 18 and an elongated bead 20 upstanding from the base 18. The bead 20 has a substantially cylindrical shape extending longitudinally of the edge member 14. As illustrated in FIGS. 2–4, the substantially cylindrical shape of the bead 20 results from a member 22 formed into an arcuate cross-sectional shape which forms an opening 24 through the bead 20. The bead 20 is attached to the base 18 by a stem 26.

The base 18 of the edge member includes a flap 28 extending rearwardly from the bead 20, a shoulder portion 30 extending forwardly and downwardly from the bead 20, and a skirt portion 32 extending downwardly from the shoulder portion 30. The edge member 14 includes a top flange 34, middle flange 36, and bottom flange 38, extending from the base 18. The flanges 34, 36, 38 extend longitudinally of the edge member 14.

The top flange 34 is connected to the shoulder portion 30 of the base, adjacent the bead 20. The top flange 34 includes a web 40 extending from the shoulder portion 30 and a lip 42 connected to a top portion of the web 40. The lip 42 extends substantially perpendicularly to the web 40 and away from the bead 20.

The middle flange 36 is connected to a top portion of the skirt portion 32, closely adjacent the shoulder portion 30. The middle flange 36 includes a web 44 extending from the skirt portion 32. An upper lip 46 and a lower lip 48 are connected to a top portion of the middle flange web 44. The upper lip 46 and the lower lip 48 extend from the web 44, substantially perpendicular to the web 44.

The bottom flange 38 is connected to a bottom portion of the skirt portion 32. The bottom flange 38 includes a web 50 extending from the skirt portion 32. A lip 52 is connected to a top portion of the bottom flange web 50. The lip 52 extends substantially perpendicular to the bottom flange web 50 and toward the middle flange 36.

An upper slot 54 is formed between the top flange lip 42 and web 40 and the middle flange upper lip 46 and web 44. A lower slot 56 is formed between the bottom flange lip 52 and web 50 and the middle flange lower lip 48 and web 44.

A hinge 58 extends from the base 18 of the edge member, at the bottom portion of the skirt portion 32, opposite the bottom flange 38. The hinge 58 forms a hinge throat 60 directed upwardly, towards the shoulder portion 30 of the edge member.

The shelf divider 12 includes an arm 64 and a front end 66. The arm 64 has a lower base edge 68 that is settable on a shelf 16. An elongated foundation member 70 provides the lower base edge 68 of the arm. A divider wall 72 extends upwardly from the foundation member 70 and connects to the front end 66. The foundation member 70 has a width greater than the width of the divider wall 72 such that the foundation member 70 and the divider wall 72 form a member having a substantially T-shaped cross-sectional area. The foundation member 70 does not extend to the front end 66 of the shelf divider, such that a cutout portion 74 is formed in the shelf divider 12, adjacent the front end 66.

The divider wall 72 of the arm 64 extends rearwardly from the front end 66. A plurality of apertures 76 are formed in a rear portion 78 of the divider wall 72. Frangible portions 80 are spaced along the rear portion 78 of the divider wall 72. At each frangible portion 80, a notch 82 is formed in the foundation member 70.

Figure 9:
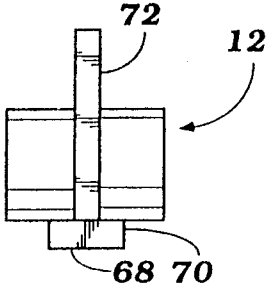
FIG. 9 is a rear end view of the shelf divider shown in FIGS. 6–8.
Figure 8:
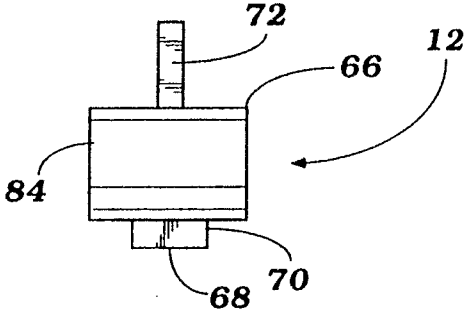
FIG. 8 is a front end view of the shelf divider shown in FIGS. 6 and 7.

The front end 66 of the shelf divider includes a hook 84. A rear portion of the hook 84 is formed integral with the divider wall 72. The hook 84 comprises a tubular body 86 defining an inner space 88. The inner space 88 has a substantially circular cross-sectional shape slightly larger than, but close to the diameter of the bead 20 of the edge member. The tubular body 86 of the hook has a width greater than the width of the foundation member 70, as illustrated in FIGS. 8 and 9.

The tubular body 86 includes jaws 90 which form a downwardly directed hook throat 92. The hook throat 92 is smaller in width than the diameter of the bead 20 of the edge member. A cam surface 94 is provided on the jaws 90. Preferably, two cam surfaces 94 are provided, one on each jaw 90.

In use, the flap 28 is placed over a front portion 96 of a top surface 100 of the shelf. The skirt portion 32 of the edge member extends over a front surface 102 of the shelf. The edge member 14 may be secured to the shelf 16 by any suitable connector, such as fasteners or adhesives inserted through fastener holes 98 in the flap 28, as shown in FIG. 5.

The shelf divider 12 is placed on the edge member 14 with the cam surfaces 94 of the jaws contacting the bead 20 and the hook throat 92 above the bead 20, as illustrated in FIG. 2. The arm 64 of the shelf divider extends across the top surface 100 of the shelf, substantially perpendicular to the bead 20.

A downward force is applied to the shelf divider 12 such that the cam surfaces 94 of the jaws are pressed against the bead 20. As the cam surfaces 94 are pressed against the bead 20 and travel across the bead 20, the tubular body 86 is pulled open such that the inner space 88 and the hook throat 92 are enlarged. Also, as the cam surfaces 94 of the jaws press against the bead 20, the bead 20 is compressed slightly into the opening 24 formed by the bead 20, as illustrated in FIG. 3. As the force is applied to the shelf divider 12, the cam surfaces 94 pass over the bead 20 and bead 20 is received in the hook throat 92, as illustrated in FIG. 3, and then in the inner space 88 of the tubular body, as illustrated in FIG. 4. As the bead 20 moves into the inner space 88, the tubular body 86 contracts, such that the hook throat 92 decreases in size until the cam surfaces 94 of the hook are adjacent the stem 26 of the bead, as illustrated in FIG. 4. In this way, the shelf divider 12 is snap-fit to the edge member 14. A plurality of shelf dividers 12 may be installed on an edge member 14, as illustrated in FIG. 1. Once the shelf divider 12 is installed on the bead 20, the shelf divider 12 extends generally perpendicular to the bead 20, as illustrated in FIG. 1.

The shelf divider 12 may be removed from the edge member 14 by applying a force to the shelf divider 12 which pivots the arm 64 of the shelf divider away from the top surface 100 of the shelf. As the force is applied, the cam surfaces 94 of the hook are pulled upwardly on the bead 20, expanding the size of the hook throat 92 and the inner space 88. As the cam surfaces 94 of the hook pass over the bead 20, the bead 20 is moved outwardly into the hook throat 92 and out of the tubular body 86. As the hook 84 is disengaged from the bead 20, the tubular body 86 of the hook contracts, decreasing the size of the hook throat 92 and the inner space 88. After the shelf divider 12 has been removed from the edge member 14, the shelf divider 12 may be reinstalled on a different portion of the edge member 14.

When the shelf divider 12 is installed on the edge member 14, the width of the tubular body 86 provides a stable connection between the bead 20 and the front end 66 of the shelf divider, as best shown in FIG. 5. The contact between the tubular body 86 and bead 20 substantially prevents or inhibits the hook 84 from being pivoted sideways relative to the bead 20 when a force is applied to the shelf divider 12 along the top surface 100 of the shelf.

In addition, when the shelf divider 12 is installed on the edge member 14, the flap 28 of the edge member is received in the cutout portion 74 of the shelf divider, as illustrated in FIGS. 1 and 4. The lower base edge 68 provided by the foundation member 70 of the arm rests on the top surface 100 of the shelf. The width of the foundation member 70 substantially prevents the shelf divider 12 from being rotated sideways relative to the bead 20 when a force is applied to the shelf divider 12 along the top surface 100 of the shelf. The connection between the tubular body 86 and the bead 20 and the stability of the wider foundation member 70 of the arm on the shelf 16 provide a shelf divider system 10 which is substantially stable when merchandise is being placed onto or removed from the shelf 16.

The shelf divider 12 may be modified to fit on various size shelves. If the arm 64 of the shelf divider is too long for a shelf 16, a portion of the shelf divider 12 may be removed by bending and breaking a rear portion 78 the shelf divider along a frangible portion 80.

The upper slot 54 and the lower slot 56 in the edge member may receive cards or tags which provide information about the merchandise on the shelf 16 for customers or inventory purposes. The hinge 58 may be used to secure advertising materials to the shelf by inserting a portion of the advertising materials into the hinge throat 60.

The apertures 76 in the rear portion 78 of the shelf divider decrease the amount of material required to fabricate the shelf divider 12 without substantially affecting the strength of the divider.

Preferably, the edge member 14 and the shelf divider 12 are formed from injection molded plastic which is flexible and resilient. Also, the edge member 14 may be formed integrally with a shelf 16.

The present invention provides a shelf divider system 10 relatively inexpensive to manufacture and install. The shelf divider system 10 may be easily modified since the snap-fit connection between the hook 84 of the shelf divider and the bead 20 of the edge member allow the shelf divider 12 to be installed, removed, and reinstalled on a shelf 16 in a convenient manner.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. For use with a shelf on which merchandise is displayed, a shelf divider system comprising:

an elongated edge member which in use is located at a front edge of a shelf, said edge member including a base, an elongated bead upstanding from said base, said bead having a substantially cylindrical shape, and a stem connecting said bead to said base; and an elongated shelf divider having an arm and a front end, said arm having a lower base edge that is settable on a shelf, said front end comprising a hook having a tubular body, said tubular body defining an inner space, said tubular body having jaws and a downwardly directed hook throat being defined between said jaws, said inner space having a substantially circular cross-sectional shape close in diameter to the diameter of said bead, and said hook throat having a width less than said diameter of said bead, whereby the shelf divider can be moved into a position above a shelf to which said edge member is secured and then moved downwardly to place said jaws on said bead and then moved further downwardly with said bead being received in said hook throat and then in said inner space to snap-fit the hook onto the bead, wherein the shelf divider extends generally perpendicular to the bead when the hook is connected to the bead; and wherein the tubular body has sufficient length such that said connection between the hook and the bead substantially prevents sideways pivotal movement of the hook relative to the bead.

2. The shelf divider system of claim 1, wherein said arm of said shelf divider further includes:

an elongated foundation member providing said lower base edge; and a divider wall extending from said foundation member, said divider wall having a width less than the width of said foundation member such that said divider wall and said foundation member form a member having a T-shaped cross-sectional area, wherein said width of said foundation member substantially preventing sideways rotational movement of said divider wall relative to said bead when said hook is connected to said bead.

3. The shelf divider system of claim 1, wherein said jaws of said tubular body further include a cam surface for camming said bead into and through said hook throat.

4. The shelf divider system of claim 3, wherein said jaws include two cam surfaces, one on either jaw for camming said bead into said hook throat.

5. An elongated shelf divider for use with a shelf having an upstanding bead extending along a front edge of said shelf, comprising:

an arm, said arm having a lower base edge that is settable on a shelf; and a front end comprising a hook having a tubular body, said tubular body defining an inner space, said tubular body having jaws and a downwardly directed hook throat being defined between said jaws, said inner space having a substantially circular cross-sectional shape close in diameter to the diameter of said bead, and said hook throat having a width less than said diameter of said bead, whereby the shelf divider can be moved into a position above a shelf with a bead and then moved downwardly to place the jaws on said bead and then moved further downwardly with said bead being received in said hook throat and then in said inner space to snap-fit the hook onto the bead, wherein the shelf divider extends generally perpendicular to the bead when the hook is connected to the bead; and wherein the tubular body has sufficient length such that said connection between the hook and the bead substantially prevents sideways pivotal movement of the hook relative to the bead.

6. The shelf divider of claim 5, wherein said arm of said shelf divider further includes:

an elongated foundation member providing said lower base edge; and a divider wall extending from said foundation member, said divider wall having a width less than the width of said foundation member such that said divider wall and said foundation member form a member having a T-shaped cross-sectional area, wherein said width of said foundation member substantially preventing sideways rotational movement of said divider wall relative to said bead when said hook is connected to said bead.

7. The shelf divider of claim 5, wherein said jaws of said tubular body further include a cam surface for camming said bead into and through said hook throat.

8. The shelf divider of claim 7, wherein said jaws include two cam surfaces, one on either jaw for camming said bead into said hook throat.

* * * * *